US007452292B2

(12) United States Patent
Kasashima et al.

(10) Patent No.: US 7,452,292 B2
(45) Date of Patent: Nov. 18, 2008

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 227 days.

(21) Appl. No.: 11/332,246

(22) Filed: Jan. 17, 2006

(65) Prior Publication Data

US 2007/0259739 A1 Nov. 8, 2007

(51) Int. Cl.
*A63B 37/12* (2006.01)

(52) U.S. Cl. ..... 473/383

(58) Field of Classification Search ..... 473/378, 473/385, 383, 373, 374
See application file for complete search history.

(56) References Cited

U.S. PATENT DOCUMENTS 6,679,791 B2 * 1/2004 Watanabe ..... 473/371
6,899,643 B2 * 5/2005 Sajima et al. ..... 473/383
6,986,720 B2 * 1/2006 Sajima et al. ..... 473/383
7,108,615 B2 9/2006 Kasashima et al.
2003/0190968 A1 * 10/2003 Kasashima ..... 473/131
2005/0113188 A1 * 5/2005 Sajima ..... 473/383
2006/0178231 A1 8/2006 Kasashima

FOREIGN PATENT DOCUMENTS

JP 2006-51352 A 2/2006
JP 2006-218294 A 8/2006

* cited by examiner

*Primary Examiner*—Raeann Trimiew
(74) *Attorney, Agent, or Firm*—Sughrue Mion, PLLC

(57) ABSTRACT

In a golf ball having, on a spherical surface, numerous dimples in a plurality of types of differing diameter, the dimples include smallest size dimples having a diameter of 2.7 mm or less and largest size dimples having a diameter of 4.3 mm or less. At least 50% of the total number of dimples are dimples in which an arc that connects mutually opposing positions on a wall of the dimple at a 70% dimple depth level with a deepest position on the dimple wall has a radius of curvature R of at least 15 mm.

26 Claims, 2 Drawing Sheets

GOLF BALL

BACKGROUND OF THE INVENTION

The present invention relates to a golf ball having an excellent flight performance.

In the past, to improve both the feel of solid golf balls on impact and their controllability, such balls were optimized for properties such as core and cover hardness under high-trajectory conditions owing to a relatively high spin rate.

It was later found that a golf ball hit at a low spin and a high launch angle will travel a longer distance. Accordingly, greater effort has come to be devoted to increasing the distance of travel in a manner that is in keeping with these findings. With recent advances in golfing equipment such as balls and clubs, designs are being worked out on drivers and other distance clubs that greatly reduce the amount of backspin taken on by a golf ball when it is hit.

Under low-spin conditions, the ball that has been hit will have a small coefficient of drag, which tends to increase its distance of travel. Yet, when the dimples that have been used in earlier golf balls are used unchanged in these more advanced golf balls, a drop occurs due to insufficient lift in the region of diminished speed after the ball has reached the highest point of its trajectory, resulting in a loss of distance.

SUMMARY OF THE INVENTION

It is thus an object of the invention to provide a golf ball having a spherical surface on which numerous dimples of differing diameter are arranged, which ball, owing to the appropriate selection of the smallest diameter dimples and the largest diameter dimples and the appropriate selection of the dimple shapes, has an optimized trajectory when hit and is thus able to advantageous increase the distance traveled by the ball.

We have conducted extensive investigations, as a result of which we have found that by using as the circular dimples arranged on the surface of a golf ball a plurality of dimples types such that the largest dimples and the smallest dimples differ markedly in their diameters, and by appropriately selecting, in cross-sections of the dimples, the shape of the dimple wall near the bottom of the dimple, the ball will have an optimized trajectory and travel farther when hit.

Accordingly, the invention provides the following golf balls.

[1] A golf ball having, on a spherical surface, numerous dimples in a plurality of types of differing diameter, wherein the dimples include smallest size dimples having a diameter of 2.7 mm or less and largest size dimples having a diameter of 4.3 mm or more, and at least 50% of the total number of dimples are dimples in which an arc that connects mutually opposing positions on a wall of the dimple at a 70% dimple depth level with a deepest position on the dimple wall has a radius of curvature R of at least 15 mm.

[2] The golf ball of [1] which has a resilient solid core, a cover made primarily of polyurethane elastomer that is disposed outside of the solid core and has thereon said dimples, and an intermediate layer made primarily of ionomer resin that is disposed between the cover and the solid core.

[3] The golf ball of [2], wherein the core has a center portion and an outer portion which is harder than the center portion, such that the core center portion and an outside surface of the core have a JIS-C hardness difference therebetween of at least 25.

[4] The golf ball of [2], wherein the core has a two-layer construction composed of an inner layer and an outer layer, said outer layer having a thickness of 5 to 15 mm.

[5] The golf ball of [2], wherein the cover is formed to a thickness of 0.5 to 1.2 mm and has a Shore D hardness of 40 to 55.

[6] The golf ball of [2], wherein the intermediate layer is formed to a thickness of 0.9 to 1.7 mm and has a Shore D hardness of 55 to 70.

[7] The golf ball of claim 1, wherein 50 to 97% of the total number of dimples are dimples in which said arc has a radius of curvature R of at least 15 mm.

[8] The golf ball of [1], wherein said arc has a radius of curvature R of 15 to 40 mm.

[9] The golf ball of [1], wherein the angle θ between a tangent J drawn at a 30% dimple depth position on the dimple wall and a circular plane formed by connecting top edge areas of the dimple is from 4 to 15°.

[10] The golf ball of [1], wherein the total number of dimples is from 250 to 370.

BRIEF DESCRIPTION OF THE DIAGRAMS

DETAILED DESCRIPTION OF THE INVENTION

The invention is described more fully below in conjunction with the attached diagrams.

Figure 1:
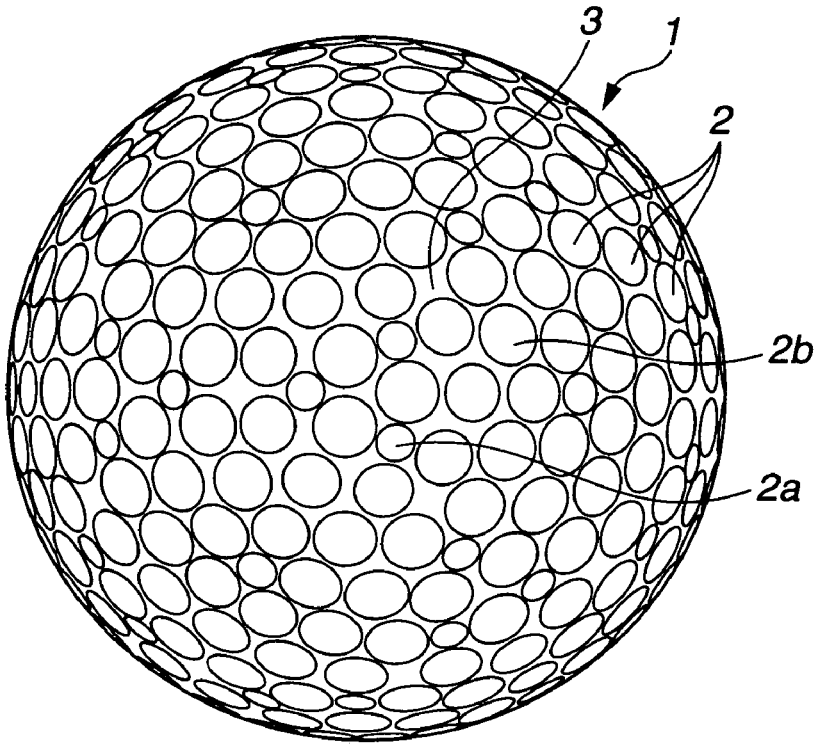
FIG. 1 is a plan view showing the surface of a golf ball according to an embodiment of the invention.
Figure 2:
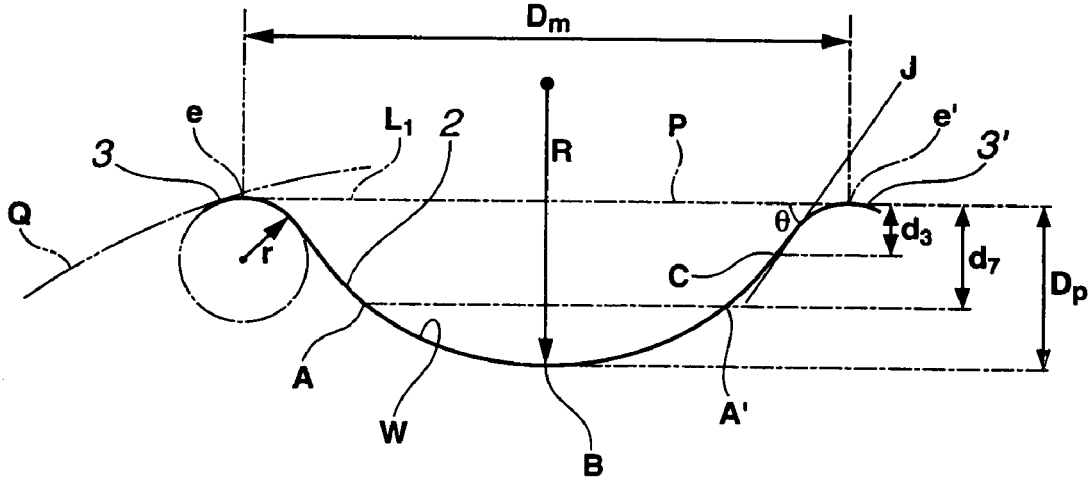
FIG. 2 is an enlarged sectional view of a dimple on the golf ball of the invention.
Figure 3:
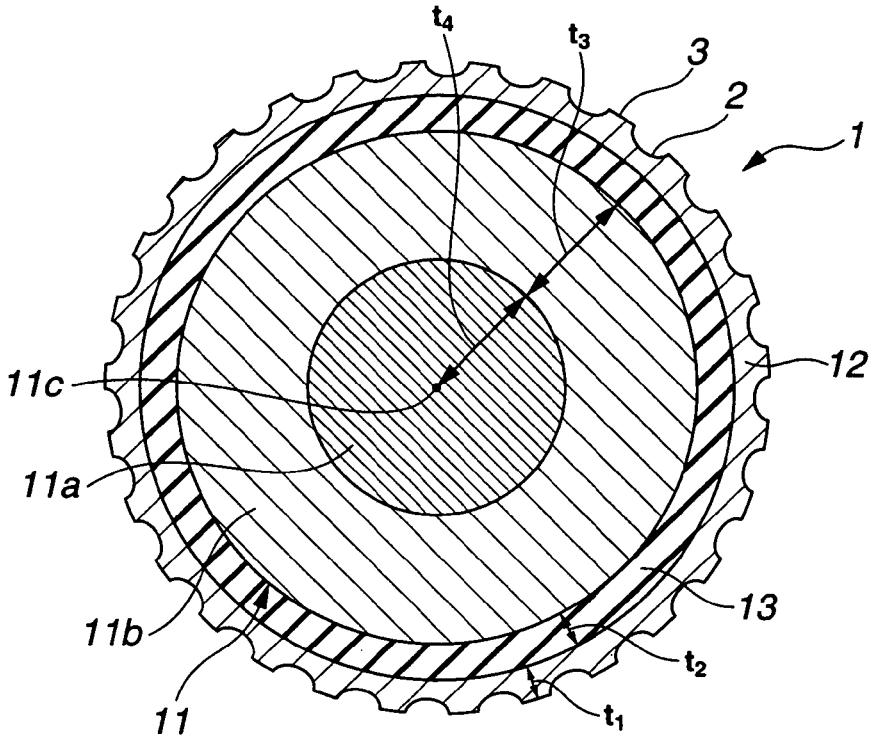
FIG. 3 is a cross-sectional view showing the internal construction (four-layer construction) of a golf ball according to an embodiment of the invention.
Figure 4:
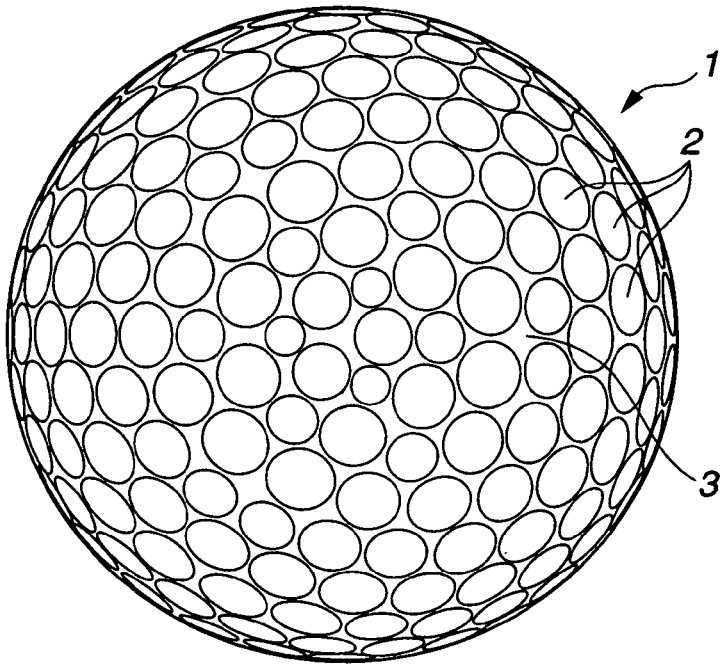
FIG. 4 is a plan view showing the surface of the golf ball in a comparative example.

FIG. 1 is a plan view of a golf ball illustrating an embodiment of the invention, FIG. 2 is a cross-sectional view of the same golf ball, and FIG. 3 is an enlarged sectional view of a dimple on the same golf ball.

Shown in FIG. 1 are a golf ball 1, numerous dimples 2 formed on the surface of the golf ball, and lands 3. The dimples are formed in shapes that are circular as seen from directly above.

FIG. 2 is a detailed view of a dimple region. If a tangent line $L_1$ is drawn so as to connect mutually opposing lands 3 and 3' across the dimple 2, the points of intersection between the tangent $L_1$ and the dimple 2 are defined as the top edge e. The top edge e of this dimple 2, like the land 3, lies at a position farthest away from the center of the golf ball 1. In FIG. 2, the diameter $D_m$ of the dimple is defined as the diameter of the circular plane P formed by connecting the top edge e and circumscribed by the top edge e (i.e., in FIG. 2, the length of the straight line (above tangent $L_1$) connecting the mutually opposed top edges e and e'). Also, the depth $D_p$ of the dimple is defined as the minimum distance between the plane P (tangent $L_1$) and the deepest part B of the dimple The golf ball of the invention has numerous dimples in a plurality of types of differing diameters. Of these dimples, the smallest dimples 2*a* have a diameter of 2.7 mm or less, and preferably 2.0 to 2.7 mm, and the largest dimples 2*b* have a diameter of 4.3 mm or more, and preferably 4.3 to 6.0 mm.

The ratio of the diameter of the largest dimples 2*b* to the diameter of the smallest dimples 2*a* is preferably at least 1.6, and more preferably from 1.6 to 3.0. By combining in this way dimples having such a large diameter ratio and optimizing the radius of curvature, the dimple surface coverage can be increased, enabling the ball to achieve a longer travel distance.

In the practice of the invention, the total number of dimples is preferably from 250 to 370, and more preferably from 280 to 350. It is preferable for the number of dimple types of differing diameter to be at least three. There is no fixed upper limit in the number of such dimple types, although from the standpoint of practicality a maximum of 5 to 20 types is preferred. The reason is that, within a range in the total number of dimples disposed on the surface of the ball of 250 to 370, when numerous large-diameter dimples having a diameter of 4.3 mm or more are used and the number of dimple types is less than three, it is difficult to arrange the dimples densely and uniformly on the spherical surface of the ball. On the other hand, when more than 20 types of dimple are used, the advantageous effects of the resulting dimple arrangement are unlikely to justify the associated increases in mold fabrication and other costs.

It is preferable for the number of the largest dimples 2*a* to be from 12 to 60 and the number of the largest dimples 2*b* to be from 120 to 350.

On the inventive golf ball, at least 50% of the total number of dimples are dimples in which an arc that connects mutually opposing positions A and A' on a wall of the dimple at a 70% dimple depth level and a deepest position B on the dimple wall has a radius of curvature R of at least 15 mm.

More specifically, the arc denoted in FIG. 2 by a dash-dot-dot line represents a ball spherical surface Q that connects the apices of the land regions which are located farthest from the center of the ball. In FIG. 2, the cross-sectional shape which is located between the left and right top edges e and e' of the dimple and surrounds the base w of the dimple from the walls thereof may be a circularly or elliptically arcuate shape which is oriented toward the center of the ball as shown in FIG. 2, a frying pan-like shape with a flat bottom, or a shape in which the bottom is convex and rises upward. However, when the arc is formed so as to connect the mutually opposing positions A and A' on the dimple wall at a 70% level ($d_7$) of the dimple depth $D_p$ and the deepest position B in the dimple, this arc has a radius of curvature R of 5 to 40 mm, and preferably 7 to 30 mm. At least 50%, and preferably 50 to 97%, of the total number of dimples are dimples in which the radius of curvature R is at least 15 mm, preferably 15 to 40 mm, and more preferably 15 to 30 mm.

Here, the above positions A, A' and B are shape setting positions which regulate the dimple shape near the deepest part of the dimple. That is, the shape near the deepest part of the dimple must pass successively through these positions A-B-A'. Yet, the shape of the dimple wall which passes through these positions A-B-A' is not necessarily limited to an arc of the above radius of curvature R, and may be modified to a variety of shapes. Hence, the actual shape of the dimple wall which passes through the positions A-B-A' may or may not coincide with the above-described arcuate shape.

By positionally regulating in this way the shape near the deepest part of the dimple and by also selecting the dimple diameter as described above, an increase in the travel distance can be achieved. If the above-described arc near the deepest part of the dimple has a radius of curvature R of less than 15 mm, after the ball that has been hit reaches its highest point on the parabolic trajectory of its flight, it will undergo a more rapid decrease in lift, shortening the distance of travel. Moreover, if the dimples in which this radius of curvature R is at least 15 mm account for less than 50% of the total number of dimples, owing to a similarly rapid decrease in lift, the distance traveled by the ball will fail to increase, making the object of the invention unattainable.

Referring again to FIG. 2, letting the surface area of the above circular plane P be the dimple surface area, to achieve a good travel distance, it is desirable that the sum $\Sigma s_R$ of this surface area for all the dimples on the ball, expressed as a ratio with respect to the surface area of the ball were it to be free of dimples (which ratio is also referred to below as the "dimple surface coverage"), be preferably at least 70%, and more preferably at least 75%. Although there is no fixed upper limit in the dimple surface coverage, the upper limit is generally about 90%.

Moreover, in FIG. 2, letting the volume of the dimple space below the circular plane P be the dimple volume $v_R$, the sum $\Sigma v_R$ of this dimple volume for all the dimples on the ball, expressed as a ratio with respect to the volume of the ball were it to be free of dimples, is preferably from 0.70 to 0.85%, and more preferably from 0.73 to 0.82%. Keeping this ratio in the above range leaves the ball less subject to the influence of the dimple cross-sectional shape and enables the distance of travel to be stabilized.

The dimple depth $D_p$ is set in a range of preferably 0.05 to 0.3 mm, and more preferably 0.08 to 0.25 mm. It is especially preferable for the smallest dimples 2*a* to have a depth of 0.05 to 0.15 mm, and for the largest dimples 2*b* to have a depth of 0.12 to 0.3 mm.

The top edge e of the dimple and its vicinity may be given an arcuate shape having a radius of curvature r. It is common practice to paint the cover of the golf ball so as to form a paint film thereon. The radius of curvature r in FIG. 2 prior to such painting is preferably from 0.3 to 3.0 mm. The dimple top edge e and its vicinity that have been formed to such a radius of curvature r enable the paint to be applied to the ball at a uniform thickness in the painting operation, thereby enhancing the durability of the paint film. The radius of curvature r after painting is preferably in a range of 0.3 to 10 mm.

Moreover, in FIG. 2, given the above-described radius of curvature r near the dimple top edge, the angle θ between a tangent J drawn at a position C on the dimple wall at a 30% level (depth $d_3$) of the dimple depth $D_p$ and the above-described circular plane P (tangent $L_1$) is preferably from 4 to 15°, more preferably from 5 to 12°, and most preferably from 6 to 10°.

In the golf ball of the invention, as shown in FIG. 3, the center of the ball is formed of a resilient solid core 11 composed of at least one layer, a cover 12 made primarily of polyurethane elastomer that is disposed outside of the solid core and has thereon the above-described dimples, and an intermediate layer 13 made primarily of ionomer resin that is disposed between the cover 12 and the solid core 11.

Here, it is preferable for the cover thickness $t_1$ to be from 0.5 to 1.2 mm and the intermediate layer thickness $t_2$ to be from 0.9 to 1.7 mm. The above thicknesses $t_1$ and $t_2$ may both be the same or one may be thicker or thinner than the other, although it is preferable for the cover thickness $t_1$ to be relatively thin. Specifically, it is preferably to set the thickness difference $t_2$-$t_1$ in a range of substantially 0 to 1 mm. With regard to hardness, it is preferable for the cover 12 to have a Shore D hardness of 40 to 55, and for the intermediate layer 13 to have a Shore D hardness of 55 to 70. It is preferable for the relative hardnesses of the two layers to be such that the cover 12 has a lower hardness than the intermediate layer 13. If the Shore D hardnesses of the intermediate layer 13 and the cover layer 12 are not set within the foregoing ranges, the ball may have a poor feel when played or an inferior flight performance.

The solid core is preferably formed to a diameter of 37 to 40 mm. Moreover, it is preferable for the outer portion of the core to be harder than the center portion, and for the center portion and the outside surface of the core to have a JIS-C hardness difference therebetween of at least 25, and especially 25 to 35. The solid core may have a one-piece construction or, as shown in FIG. 3, a multi-piece construction composed of an inner layer 11*a* and an outer layer 11*b*. In such a case, the thickness $t_3$ of the outer layer 11*b* may be set at 5 to 15 mm, the thickness (radius) $t_4$ of the inner layer 11*a* may account for the remaining thickness, and the outer layer may be formed so as to be harder, within the above-indicated JIS-C hardness range. FIG. 3 also shows the center 11*c* of the ball.

When the resilient core is thus formed as a plurality of layers, by resorting, for example, to the use of a rubber material in the inner layer 11*a* and a resin material in the outer layer 11*b*, the distinctive properties of the respective materials may be utilized to optimize the hardness distribution throughout the resilient core.

In the resilient solid core 11 used in the invention, the inner layer 11*a* and the outer layer 11*b* may be formed using, for example, a rubber composition containing suitable ingredients such as known co-crosslinking agents, organic peroxides, inert fillers and organosulfur compounds. It is preferable to use polybutadiene as the base rubber in such a rubber composition. In the case of a two-layer construction consisting of an inner layer and an outer layer like that shown in FIG. 3, it is preferable to use polybutadiene rubber in both.

The material used to make up the resin cover 12 in the invention is preferably a thermoplastic polyurethane elastomer. The material used to make up the intermediate layer 13 in the invention, while not subject to any particular limitation, may be a known synthetic resin. For example, preferred use can be made of a thermoplastic resin or thermoplastic elastomer (e.g., ionomer resin, thermoplastic polyester elastomer, polyurethane resin, thermoplastic olefin type elastomer) as the primary material.

The inventive golf ball can be manufactured by a known method. Ball properties such as weight and diameter may be suitably selected according to the Rules of Golf. The ball may generally be formed to a diameter of not less than 42.67 mm and a weight of not more than 45.93.

As described above, the golf ball of the invention, in addition to having a construction which includes a resilient core of one or more layers, an intermediate layer and a resin cover, employing a selected resilient core hardness distribution and a selected resin cover material, and having optimized intermediate layer and cover hardnesses, also has a dimple construction and a dimple arrangement which are optimized. Accordingly, the inventive ball, through an integral combination of internal features and dimple parameters, has a significantly increased travel distance, making it highly advantageous for competitive use.

EXAMPLES

The following Example of the invention and Comparative Example are provided by way of illustration and not by way of limitation.

Example and Comparative Example

Solid cores having a diameter of 38.2 mm were produced from the formulations shown in Table 1 by a conventional procedure. The core in the example of the invention had a two-layer construction composed of an inner layer and an outer layer, the inner layer having a diameter of 23.8 mm and the outer layer having a thickness of 7.2 mm.

TABLE 1

| | Example | | |
|---|---|---|---|
| Ingredients (parts by weight) | Inner layer | Outer layer | Comparative Example |
| Polybutadiene BR730 | 100 | 100 | 100 |
| Zinc acrylate | 31 | 36 | 31 |
| Zinc oxide | 22.6 | 21.0 | 22.6 |
| Zinc stearate | 5 | 5 | 5 |
| Zinc salt of pentachlorothiophenol | 0.2 | 0.2 | 0.2 |
| 2,2'-Methylenebis(4-methyl-6-t-butylphenol) | 0.1 | 0.1 | 0.1 |
| Dicumyl peroxide | 0.3 | 0.3 | 0.3 |
| 1,1-Bis(t-butylperoxy)cyclohexane, 40% dilution | 0.3 | 0.3 | 0.3 |

Notes:
Polybutadiene BR730: Produced by JSR Corporation
Zinc acrylate: Produced by Nihon Jyoryu Kogyo Co., Ltd.
Zinc oxide: Produced by Sakai Chemical Industry Co., Ltd.
Zinc stearate: Produced by NOF Corporation
2,2'-Methylenebis(4-methyl-6-t-butylphenol): Produced by Ouchi Shinko Chemical Industry Co., Ltd.
Dicumyl peroxide: Produced by NOF Corporation
1,1-Bis(t-butylperoxy)cyclohexane, 40% dilution: Produced by NOF Corporation Next, an intermediate layer (1.3 mm) and a cover (0.95 mm) were each formed by injection molding the formulations shown below, along with which dimples having the parameters shown in Table 2 were formed.

The respective materials shown below were used to form the intermediate layer and the cover in both the example of the invention and the comparative example.

Intermediate Layer

H1605: A sodium ion-neutralized ethylene-methacrylic acid copolymer ionomer produced by DuPont-Mitsui Polychemicals Co., Ltd.

Cover

Pandex T8295: An MDI-PTMG type thermoplastic polyurethane produced by DIC Bayer Polymer, Ltd.

Pandex T8260: An MDI-PTMG type thermoplastic polyurethane produced by DIC Bayer Polymer, Ltd.

Crossnate EM-30: An isocyanate produced by Dainichi Seika Colour & Chemicals Mfg. Co., Ltd.

The cover material was prepared by blending 18 parts by weight of Crossnate EM-30 into a mixture of 50 parts by weight of Pandex T8295 and 50 parts by weight of Pandex T8260.

TABLE 2

| | Example | | | | | | Comparative Example | | | | |
|---|---|---|---|---|---|---|---|---|---|---|---|
| Type | $D_1$ | $D_2$ | $D_3$ | $D_4$ | $D_5$ | $D_6$ | $D_1$ | $D_2$ | $D_3$ | $D_4$ | $D_5$ |
| Number of dimples n | 12 | 234 | 60 | 6 | 6 | 12 | 288 | 60 | 12 | 12 | 60 |

TABLE 2-continued

| | Example | | | | | | Comparative Example | | | | |
|---|---|---|---|---|---|---|---|---|---|---|---|
| Type | $D_1$ | $D_2$ | $D_3$ | $D_4$ | $D_5$ | $D_6$ | $D_1$ | $D_2$ | $D_3$ | $D_4$ | $D_5$ |
| Diameter (mm) | 4.6 | 4.4 | 3.8 | 3.5 | 3.4 | 2.6 | 3.9 | 3.8 | 3.4 | 2.9 | 2.4 |
| Depth d (mm) | 0.14 | 0.14 | 0.14 | 0.13 | 0.13 | 0.10 | 0.15 | 0.15 | 0.14 | 0.13 | 0.10 |
| R (mm) | 22 | 19 | 14 | 11 | 10 | 8 | 13 | 13 | 11 | 9 | 8 |
| θ (°) | 7 | 7 | 8 | 8 | 8 | 8 | 9 | 9 | 9 | 10 | 9 |
| Total number of dimples Σn | 330 | | | | | | 432 | | | | |
| $\Sigma v_R$ ($mm^3$) | 313 | | | | | | 321 | | | | |
| $\Sigma s_R$ ($mm^2$) | 4614 | | | | | | 4564 | | | | |
| Total volume ratio (%) | 0.77 | | | | | | 0.79 | | | | |
| Total surface area ratio (%) | 81 | | | | | | 80 | | | | |

Notes:
R: The radius of curvature of the arc that passes through positions A and A' on the dimple wall at 70% of the dimple depth ($d_7$).
θ: The angle between a tangent J at a position D on the dimple wall at 30% of the dimple depth ($d_3$) and a circular plane P.
$\Sigma v_R$: Total volume of the dimples.
$\Sigma s_R$: Total surface area of the dimples.
Total volume ratio: Ratio of total volume of all dimples on the ball to the volume of the ball were the surface to be free of dimples.
Total surface area ratio: Ratio of total surface area of all dimples on the ball to the surface area of the ball were the surface to be free of dimples.

Ball Construction and Test Results

Table 3 shows the ball constructions in the example of the invention and the comparative example, and also shows the results of distance tests conducted on these balls. In the distance test, each ball was hit at a head speed of 45 m/s with a club (W#1) mounted on a swing robot, and both the carry and the total distance were measured.

TABLE 3

| | | Example | Comparative Example |
|---|---|---|---|
| Ball | Diameter (mm) | 42.7 | 42.7 |
| Resilient core | Radius (mm) | 19.1 | 19.1 |
| | Construction | two-piece | one-piece |
| | (A) Center hardness (JIS-C hardness) | 61 | 66 |
| | (B) Outer surface hardness (JIS-C hardness) | 89 | 77 |
| | (B) − (A) | 28 | 11 |
| Intermediate layer | Thickness $t_2$ (mm) | 1.30 | 1.30 |
| | Shore D hardness | 64 | 64 |
| Cover | Thickness $t_1$ (mm) | 0.95 | 0.95 |
| | Shore D hardness | 53 | 53 |
| Test results | Carry (m) | 223 | 219 |
| | Total distance (m) | 244 | 240 |

Notes:
(1) In the two-piece core construction in the example of the invention, the core had an outer layer thickness $t_3$ of 7.2 mm and an inner layer radius $t_4$ of 11.95 mm. The core radius in the comparative example was 18.65 mm.
(2) The Shore D hardnesses are values obtained by measurement in accordance with ASTEM-D2240.

The invention claimed is:

1. A golf ball comprising:

a resilient solid core comprising at least two discrete layers; and a plurality of dimples in a plurality of types of differing diameters and disposed on a spherical surface, wherein the dimples include smallest size dimples having a diameter of 2.7 mm or less and largest size dimples having a diameter of 4.3 mm or more, and at least 50% of the total number of dimples are dimples in which an arc that connects mutually opposing positions on a wall of the dimple at a 70% dimple depth level with a deepest position on the dimple wall has a radius of curvature R of at least 15 mm, wherein a top edge of the dimples and their vicinity have an arcuate shape having a radius of curvature, and the radius of curvature prior to painting is within the range 0.3 to 3 mm.

2. The golf ball of claim 1 further comprising a cover made primarily of polyurethane elastomer that is disposed outside of the solid core and has thereon said dimples, and an intermediate layer made primarily of ionomer resin that is disposed between the cover and the solid core.

3. The golf ball of claim 2, wherein the core has a center portion and an outer portion which is harder than the center portion, such that the core center portion and an outside surface of the core have a JIS-C hardness difference therebetween of at least 25.

4. The golf ball of claim 2, wherein an outer layer of the core has a thickness of 5 to 15 mm.

5. The golf ball of claim 2, wherein the cover is formed to a thickness of 0.5 to 1.2 mm and has a Shore D hardness of 40 to 55.

6. The golf ball of claim 2, wherein the intermediate 35 layer is formed to a thickness of 0.9 to 1.7 mm and has a Shore D hardness of 55 to 70.

7. The golf ball of claim 1, wherein 50 to 97% of the total number of dimples are dimples in which said arc has a radius of curvature R of at least 15 mm.

8. The golf ball of claim 1, wherein said arc has a radius of curvature R of 15 to 40 mm.

9. The golf ball of claim 1, wherein an angle θ between a tangent J drawn at a 30% dimple depth position on the dimple wall and a circular plane formed by connecting top edge areas of the dimple is from 4 to 15°.

10. The golf ball of claim 1, wherein the total number of dimples is from 250 to 370.

11. The golf ball of claim 1, wherein a cover made primarily of thermoplastic polyurethane elastomer is disposed outside of the solid core.

12. The golf ball of claim 1, wherein an inner layer of the core is formed of a rubber material and an outer layer of the core is formed of a resin material.

13. The golf ball of claim 2, wherein assuming that $t_1$ denotes the cover thickness, and $t_2$ denotes the intermediate layer thickness, the thickness difference $t_2$-$t_1$ is within a range of substantially 0 to 1 mm.

14. A golf ball comprising:

a resilient solid core;

a plurality of dimples in a plurality of types of differing diameters and disposed on a spherical surface, wherein the dimples include smallest size dimples having a diameter of 2.7 mm or less and largest size dimples having a diameter of 4.3 mm or more, and at least 50% of the total number of dimples are dimples in which an arc that connects mutually opposing positions on a wall of the dimple at a 70% dimple depth level with a deepest position on the dimple wall has a radius of curvature R of at least 15 mm;

a cover made primarily of polyurethane elastomer that is disposed outside of the solid core and has thereon said dimples; and an intermediate layer made primarily of ionomer resin that is disposed between the cover and the solid core, wherein the core has a two-layer construction composed of an inner layer and an outer layer, said outer layer having a thickness of 5 to 15 mm.

15. A golf ball comprising:

a plurality of dimples in a plurality of types of differing diameters and disposed on a spherical surface, wherein the dimples include smallest size dimples having a diameter of 2.7 mm or less and largest size dimples having a diameter of 4.3 mm or more, and at least 50% of the total number of dimples are dimples in which an arc that connects mutually opposing positions on a wall of the dimple at a 70% dimple depth level with a deepest position on the dimple wall has a radius of curvature R of at least 15 mm, wherein an angle θ between a tangent J drawn at a 30% dimple depth position on the dimple wall and a circular plane formed by connecting top edge areas of the dimple is from 4 to 15°.

16. The golf ball of claim 15, which has a resilient solid core, a cover made primarily of polyurethane elastomer that is disposed outside of the solid core and has thereon said dimples, and an intermediate layer made primarily of ionomer resin that is disposed between the cover and the solid core.

17. The golf ball of claim 15, wherein 50 to 97% of the total number of dimples are dimples in which said arc has a radius of curvature R of at least 15 mm.

18. The golf ball of claim 15, wherein said arc has a radius of curvature R of 15 to 40 mm.

19. The golf ball of claim 15, wherein a top edge of the dimples and their vicinity have an arcuate shape having a radius of curvature, and the radius of curvature prior to painting is within the range .0.3 to 3 mm.

20. The golf ball of claim 15, wherein a cover made primarily of thermoplastic polyurethane elastomer is disposed outside of the solid core.

21. The golf ball of claim 15, wherein an inner layer of the core is formed of a rubber material and an outer layer of the core is formed of a resin material.

22. The golf ball of claim 16, wherein the core has a center portion and an outer portion which is harder than the center portion, such that the core center portion and an outside surface of the core have a JIS-C hardness difference therebetween of at least 25.

23. The golf ball of claim 16, wherein assuming that $t_1$ denotes the cover thickness, and $t_2$ denotes the intermediate layer thickness, the thickness difference $t_2$-$t_1$ is within a range of substantially 0 to 1 mm.

24. The golf ball of claim 16, wherein the core has a two-layer construction composed of an inner layer and an outer layer, said outer layer having a thickness of 5 to 15 mm.

25. The golf ball of claim 16, wherein the cover is formed to a thickness of 0.5 to 1.2 mm and has a Shore D hardness of 40 to 55.

26. The golf ball of claim 16, wherein the intermediate layer is formed to a thickness of 0.9 to 1.7 mm and has a Shore D hardness of 55 to 70.

* * * * *